United States Patent [19]

Fenelle et al.

[11] 4,304,973

[45] Dec. 8, 1981

[54] RUGGED LOW FORCE SWITCH APPARATUS

[75] Inventors: Thomas J. Fenelle, Ridgefield, N.J.; Jip F. Chun, Jamaica, N.Y.

[73] Assignee: Otis Elevator Company, Hartford, Conn.

[21] Appl. No.: 122,341

[22] Filed: Feb. 19, 1980

Related U.S. Application Data

[63] Continuation of Ser. No. 968,653, Dec. 11, 1978, abandoned.

[51] Int. Cl.[3] ..... H01H 3/12

[52] U.S. Cl. ..... 200/330; 200/159 B; 200/340

[58] Field of Search ..... 200/340, 159 B, 5 A, 200/330

[56] References Cited

U.S. PATENT DOCUMENTS

| | | | |
|---|---|---|---|
| 2,740,023 | 3/1956 | Kryder | 200/302 |
| 3,308,253 | 3/1967 | Krakinowski | 200/159 B |
| 3,494,550 | 2/1970 | Hayes et al. | 200/159 B |
| 3,862,381 | 1/1975 | Glaister et al. | 200/159 B |
| 3,978,297 | 8/1976 | Lynn et al. | 200/340 |
| 3,999,025 | 12/1976 | Sims | 200/159 B |
| 4,033,030 | 7/1977 | Robinson et al. | 200/159 B |
| 4,060,703 | 11/1977 | Everett | 200/159 B |
| 4,090,045 | 5/1978 | Marsh | 200/159 B |
| 4,181,826 | 1/1980 | Lataslewicz | 200/340 |

*Primary Examiner*—John W. Shepperd
*Attorney, Agent, or Firm*—Robert E. Greenstien

[57] ABSTRACT

A pressure plate is depressed to actuate a momentary closing switch by exerting pressure on a flexible cover on the switch through a semi-rigid separator and an elastomeric diaphragm. A projection on the plate contacts the separator to focus the pressure on a portion thereof. A foam ring is disposed around the projection and between the plate and separator and is compressed as the plate is depressed.

4 Claims, 2 Drawing Figures

RUGGED LOW FORCE SWITCH APPARATUS

CROSS REFERENCE TO RELATED APPLICATIONS

This application is a continuation of copending application Ser. No. 968,653 filed on Dec. 11, 1978, now abandoned.

BACKGROUND OF THE INVENTION

This invention relates generally to low force switches, and, in particular, ruggedized low force switches for applications such as elevator control buttons.

Elevator control buttons are provided in hallways and elevator cars to request and direct elevator service. A particularly popular button utilizes a cold cathode gas tube actuated by the mere touch of the user's finger. The tube also glows to provide illumination indicating a service request. Its activation results from the capacitance associated with the user's finger when touching a control terminal on the button connected to the gas tube. It is quite understandable that a particularly appealing feature of this button is the "soft touch" imparted to the user simply because no mechanical motion or force is required for its activation. Furthermore, because no force is required, the temptation to pound repeatedly on the button is minimized significantly. The application of the cold gas tube in an elevator control button is the subject of the following U.S. patents, wherein its operation is described in much amplified detail: U.S. Pat. Nos. 2,525,767; 2,525,768 and 2,525,769.

In certain other elevator installations, mechanical type switches are used in lieu of the gas tube. Needless to say, it is still preferred and desired to achieve the "soft touch". In fact, some of these installations are retrofits for the gas tube button and use the switch apparatus described in commonly owned, copending application Ser. No. 952,223, TRANSISTORIZED ELEVATOR CONTROL BUTTON, filed Oct. 17, 1978 by Brooks.

An exceptionally appealing way to achieve this end is to use low force switches, particularly those characterized by nearly imperceptible movement for actuation and more importantly a very low force requirement, usually about 1.5 grams; for example, as shown in U.S. Pat. No. 3,862,381 to Glaister, et al. A particularly attractive switch of this type contains a small dot of conductive material mounted on a flexible cover. A light force is applied to the cover, in the area of the dot, in order to press its dot against a grid of conductive material connected to the switch terminals. The dot shorts the grid to complete the circuit between the terminals. The flexible cover is usually thin and has inherent resiliency which causes the switch to recover to its normal nonactuated condition when the force is removed therefrom. Suffice it to say, these switches are particularly fragile and delicate; sharp blows or excessive or concentrated force on the cover can result in damage thereto, not to mention the dot and the grid. The result can be a dramatic reduction in useful switch life.

An elevator control button, needless to say, is particularly vulnerable to harsh and abusive treatment from its various, sundry users. Practical considerations dictate that an elevator control button must contain a touch or pressure plate of reasonably large surface area so as to enable a user to conveniently touch it. Generally speaking, a useful area will be considerably larger than the area on the cover of these low force switches to which force is applied for actuation; see, for example, U.S. Pat. No. 4,033,030 to Robinson, et al. The force applied to the pressure plate therefore must be concentrated into a small area for actuation, and hence, there is considerable possibility that the switch will be damaged by a user who applies too much pressure, sustained pressure or pounds repeatedly on the button. For this reason, the use of commercially available low force switches of this type, as well as other related types, in elevator control buttons has been heretofore impractical; principally because the switch would have an undesirably short service life.

SUMMARY OF THE INVENTION

Objects of the present invention include providing a rugged low force switch apparatus particularly, but not exclusively, suited for elevator control buttons in that a "soft touch" operation is achieved along with a satisfactory service life.

In accordance with the present invention, a low force switch of the general type actuated by applying pressure to a flexible cover or pressure responsive service thereon is actuated not by applying pressure directly to the cover, but rather through a semi-rigid separator over which the force is nearly evenly distributed and an elastomeric diaphragm providing a uniform shock absorbing interface or pad between the separator and the cover. To actuate this switch, pressure is applied to a pressure or touch plate which contains a projection for focusing or centering the pressure onto a portion of the separator. In response, this portion assumes a smooth curved shape oriented towards the cover. The pressure is substantially evenly distributed over this curve. A feature of the separator is its inherent characteristic not to conform to the shape of the projection applying pressure thereto. This assures that the desired smooth curvature is attained. A corresponding conforming portion of the elastomeric diaphragm is thrust or pushed against the cover in order to apply pressure to the cover to actuate the switch. A contrasting feature here of the diaphragm is its inherent characteristic to conform to the curve in the separator. In doing so, it fills any voids between the separator and the cover, and, of equal importance, provides a uniform and shock absorbing interface. Hence, the separator and diaphragm provide an exceptionally effective medium through which pressure is distributed on the cover. An additional feature is the use of a foam ring between the plate and separator to provide resilient support for the plate to prevent it from tipping or skewing as it is depressed. This is important since it maximizes the surface area of the curve and that minimizes the pressure on the cover.

Additional objects, benefits, features and applications of the present invention to elevator control buttons as well as other control applications will become apparent to those skilled in the art from the following drawing, detailed description and claims wherein:

DETAILED DESCRIPTION

Figure 1:
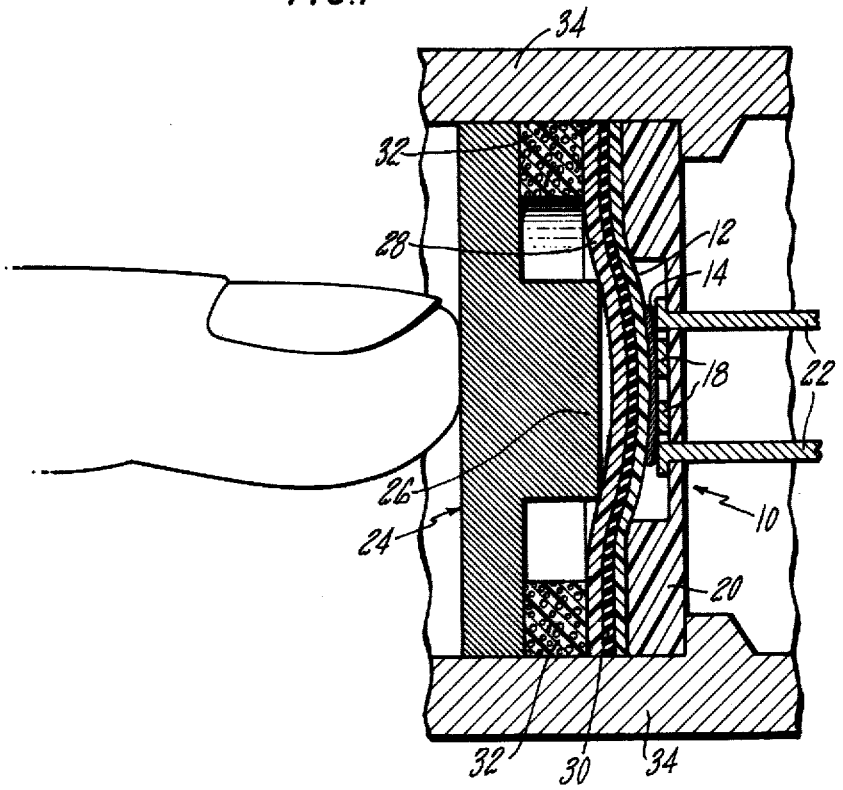
FIG. 1 is a cross section of a low force switch apparatus in accordance with the present invention shown in its actuated state and situated in a simplified housing therefor, partially shown.

In FIG. 1, a low force switch 10 is shown in an actuated condition. The switch includes a flexible cover 12 to which pressure is applied to push a contact 14, a dot of conductive material thereon, against a grid contact consisting of several conductive strips 18 mounted on a rigid back plate 20 and to which the switch terminals 22 are connected. In this manner the terminals are connected as the strips 18 are shorted together through the contact 14. This switch is what is commonly referred to as a low force button or wafer switch, and a preferred version is commercially available from Centralab Electronics Division of Globe Union of Milwaukee, Wis., Model 25MD2000N7505. This particular switch usually requires approximately 1.5 grams of actuating force upon the flexible covering to bring the contacts together for actuation. Other similar operating switches may also be available.

Finger pressure is applied to a pressure plate 24 in order to bring the contacts together. Specifically, the pressure plate 24 includes a projection 26 which is pushed against a portion of a pliable or semi-rigid separator 28 to produce the curve or bulge therein that is shown in FIG. 1. A corresponding and conforming bulge is produced in an elastomeric diaphragm 30 directly adjacent as the plate is depressed and through this diaphragm the pressure from the projection 26 is transmitted to the cover 12 whereupon the switch is actuated as shown.

The separator is constructed of a plastic or thin metal to give it a pliable or semi-rigid characteristic, so that it inherently produces a smooth curve throughout the area contacted by the front face of the projection 26. In other words, it cannot conform to the exact shape of the projection but instead defines a curve between its ends. The separator can be constructed of Mylar plastic 0.016 inches thick, this being the preferred dimensions in conjunction with the previous Centralab switch in an elevator control button, although different dimensions can provide different performance characteristics for other applications. Thus, the separator 28 functions as a force or pressure distributor in the switch apparatus.

Figure 2:
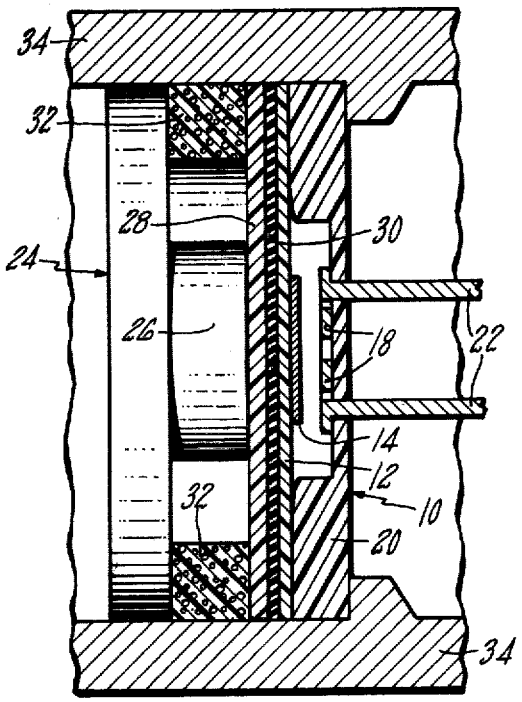
FIG. 2 is a cross section of the apparatus in FIG. 1 in its nonactuated state.

The elastomeric diaphragm 30 provides a shock absorption interface between the separator 28 and the cover 12, and of equal importance, it serves as a soft pad to fill any voids or spaces between the separator and cover to maximize the area on the cover to which the pressure is applied. In FIG. 2, this is depicted as the slight flattening in the side of the diaphragm as it is pushed against the cover. The opposite side, as shown, conforms to the curved portion of the separator at the same time. The diaphragm is constructed of rubber, i.e. neoprene and may be about 0.005 inches thick. It is important to observe that without the presence of the separator, the diaphragm would readily conform to the shape of the projection and, thus, an uneven pressure distribution upon the cover might result. Analogously, without the presence of the diaphragm, the plastic separator would not necessarily have a smooth resilient interface with the cover and an undesirable pressure distribution might also result. It is obvious therefore that the cooperation between the separator and the diaphragm is an integral facet of the invention.

As the plate 24 is depressed, a foam ring 32, located around the projection and between the separator and the plate is compressed. This ring is constructed of a foam material, i.e. urethane; its important feature is that as the plate is depressed, it provides coaxial resiliency, which opposes inward depression of the plate as it moves with walls 34 of the housing or container for the switch apparatus. The housing configuration beyond the walls 34 is not specifically shown, as it has no relevance to the invention, but any configuration which includes the walls will suffice. In the instance of an elevator button, for example, prior art housings may be used so as to provide a button with the same appearance and illumination. The effect of the ring is not only to provide additional rebound for the plate after the finger is removed, but axial support to prevent skewing or tipping of the plate. Otherwise, it is possible that less than the entire front face of the projection 26 will contact the separator; that can result in a considerably smaller curve in the separator; hence, the pressure on the cover 12 would be greater. Consequently, the ring is important in maximizing the area of the curve on the separator so as to minimize the pressure applied to the cover. As shown, in its relaxed condition (FIG. 2) its thickness is about the height of the projection 26. This is not critical, however, except that it determines the distance between the edge of the projection of the cover in the nonactuated state. The cover 12 is also semi-rigid and, thus, rebounds away when pressure is removed to open the circuit between the terminals 22 as demonstrated in FIG. 2. With the switch thereby nonactuated, the separator 28 and diaphragm 3 are generally planar, and the pressure plate is moved back with the foam ring fully expanded.

The overall thickness of the plastic separator determines the amount of force required to actuate the switch. If it is extremely thick, a significant amount of force is needed to produce the required curvature to move the cover the proper distance to short the grids 18 with contact 14. On the other hand, if the separator is made extremely thin, the switch can be actuated in response to aberrational forces such as changes in atmospheric condition when users walk by. This is because amplification results from the simple fact that the surface area on the pressure plate 26 to which force is applied (the front 38) is significantly larger than the area of the projection 26 that contacts the separator.

The foregoing mentioned dimensions with respect to the separator and diaphragm in the particular utilization of the Centralab model switch have been found to be satisfactory in an elevator control button where the standard is the desired "soft touch" feel vis-a-vis the cold gas tube button of the prior art. Needless to say, the utilization of the apparatus of the present invention in other applications therefore may require different dimensions, even if the aforementioned switch is utilized. Such applications might be pinball machines, controls for home, amusement games and controls for automobile vehicles. In actuality, the present apparatus will have application in any installation wherein the low force switch of this variety (that is those using a pressure responsive cover for actuation), but where it is also desired to achieve additional ruggedness for increased reliability. As mentioned before, however, the housing for the apparatus is not significant to its operation, although it can be used in significantly different housings geared to specific application needs. For example, in an elevator button, the housing could be illuminated and suitably constructed in the configuration of the housing for the cold gas tube in the aforementioned patents; only the internals of the housing are changed to effect a retrofit in this instance.

While the foregoing is a description of the preferred embodiment of the best mode for the present invention now known, there will undoubtedly be various modifications and variations thereto which nevertheless embrace the invention's true scope and spirit. The claims that follow are intended to be construed as claiming all such modifications and variations.

We claim:

1. A switch apparatus, comprising:

a low force switch of the type having a resilient cover thereon to which force is applied for actuating said switch;

a pressure plate which is depressed for applying said actuating force to said cover, said plate including a force concentrating projection having a flat surface through which said force is applied to said cover; and a generally planar semirigid separator; and a generally planar elastomeric diaphragm;

said separator and said diaphragm being disposed between said plate and said cover; said actuating force being transmitted from said plate to said cover as said projection is forced against a portion of said separator, said portion thereby forcing a corresponding portion of said diaphragm against said cover;

said separator being characterized in that said portion is smoothly curved and said actuating force is substantially evenly distributed over said portion; and said diaphragm being characterized in that said corresponding portion conforms to said separator portion and provides a cushion between said separator portion and said cover.

2. A switch apparatus according to claim 1, wherein said separator is constructed of a plastic material, said diaphragm is constructed of a rubber material, and said diaphragm is substantially thinner than said separator.

3. A switch apparatus according to claim 1, further comprising: means disposed around said projection for resiliently supporting said plate as it is depressed for maximizing the contact area between said projection and said separator.

4. A switch apparatus according to claim 3, wherein said means comprises a ring which is compressed as said plate is depressed, said ring being constructed of a foam material.

* * * * *